US006688026B1

(12) United States Patent
Clark

(10) Patent No.: US 6,688,026 B1
(45) Date of Patent: Feb. 10, 2004

(54) MESH NETTING FOR ADVERTISING AT SPORTING VENUE

(76) Inventor: Teriel T. Clark, 103 W. Plum St., Aubrey, TX (US) 76227

( * ) Notice: Subject to any disclaimer, the term of this patent is extended or adjusted under 35 U.S.C. 154(b) by 0 days.

(21) Appl. No.: 10/370,193

(22) Filed: Feb. 20, 2003

Related U.S. Application Data

(60) Provisional application No. 60/402,717, filed on Aug. 12, 2002.

(51) Int. Cl.[7] ..... G09F 17/00

(52) U.S. Cl. ..... 40/604; 40/584; 40/606.03

(58) Field of Search ..... 40/604, 602, 603, 40/584, 606.03

(56) References Cited

U.S. PATENT DOCUMENTS 507,952 A * 10/1893 White ..... 40/583

3,964,197 A * 6/1976 Tucker et al. ..... 40/584

FOREIGN PATENT DOCUMENTS

EP 20104149 U * 9/2002 ..... G09F/23/00

* cited by examiner

*Primary Examiner*—Gary Hoge
(74) *Attorney, Agent, or Firm*—Wayne J. Colton, Inc.

(57) ABSTRACT

A mesh spectator safety netting with provision for advertising at a sporting event generally comprises a protective net provided with an applique for the conveyance of a commercial message. In order that the spectators at a sporting venue may be presented with a marketing communication without obstruction of their view of the athletic field, the applique generally comprises a mesh of only slightly less dimension than has the mesh of the protective net. Reflective borders may be added about the applique and or colored fibers may be used in forming the mesh in order to enhance the ability to view the advertising message from the spectator stands.

12 Claims, 3 Drawing Sheets

MESH NETTING FOR ADVERTISING AT SPORTING VENUE

RELATED APPLICATION

This application claims all available benefit, under 35 U.S.C. §119(e), of U.S. provisional patent application Serial No. 60/402,717 filed Aug. 12, 2002. By this reference, the full disclosure of U.S. provisional patent application Serial No. 60/402,717 is incorporated herein as though now set forth in its entirety.

FIELD OF THE INVENTION

The present invention relates to advertising at sporting events. More particularly, the invention relates to a sporting spectator safety net having provision made thereon for the display of advertising content with little or no interference with the view onto a sporting field from the spectator seating area.

BACKGROUND OF THE INVENTION

As depicted in FIG. 1, protective netting 10 is commonly utilized at sporting venues 16 for protecting spectators 21 from sporting objects thrown or kicked from an athletic field 22. As shown in the figure, such a protective net 10 is typically suspended by a plurality of cables 19 from the ceiling 18 of an enclosed stadium 17 or, in the alternative, stretched between a plurality of frame structures (not shown) provided for this specific purpose. In any case, the protective net 10 generally comprises a fairly wide mesh 11 such that the spectators 21 in the stadium 17 retain a substantially unobstructed view of the goal 20 or other areas of the field 22 upon which may occur the sporting action.

Additionally, although the width of the mesh 11 will vary according to whether the protective net 10 is designed to prevent passage of small objects, such as hockey pucks, or large objects, such as footballs, it is known that forming the mesh 11 from black colored material allows the spectators 21 a substantially clear view of the field 22 even in the case of relatively fine dimension mesh 11.

While much attention has been given to the protection of spectators 21 at a sporting venue 16 through the provision of safety nets 10, Applicant knows of no efforts directed toward utilizing such safety provisions for the generation of team or sponsor revenues. In particular, Applicant has discovered that the protective nets 10 typically found at various sporting venues 16 generally represent a missed opportunity for the conveyance of advertising messages and/or promotional communications. It is therefore an overriding object of the present invention to improve over the prior art by adapting the otherwise typical protective nets 10 such that commercial speech may be incorporated into the protective net 10 with little or no detriment to the spectator's ability to clearly view the athletic field 22. Additionally, it is an object of the present invention to provide such an improvement that is economical to implement and easily modified between various sporting events.

SUMMARY OF THE INVENTION

In accordance with the foregoing objects, the present invention - a mesh spectator safety netting with provision for advertising at a sporting event - generally comprises a protective net provided with an applique for the conveyance of a commercial message. In order that the spectators at a sporting venue may be presented with a marketing communication without obstruction of their view of the athletic field, the applique of the present invention generally comprises a mesh of only slightly less dimension than has the mesh of the protective net. Reflective borders may be added about the applique and or colored fibers may be used in forming the mesh in order to enhance the ability to view the advertising message from the spectator stands.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
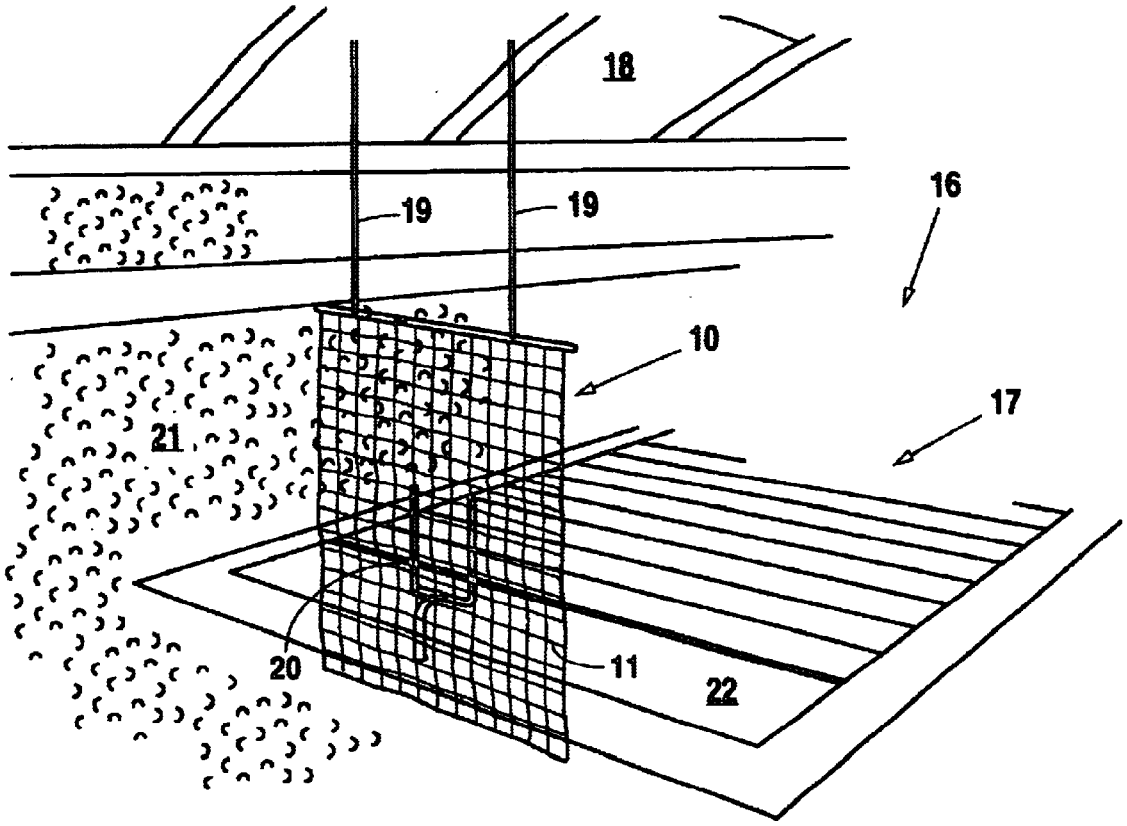
Fig. 1 (PRIOR ART)
FIG. 1 shows, in a perspective view, a typical prior art protective net as may be found in any of a variety of sporting venues.
Figure 2:
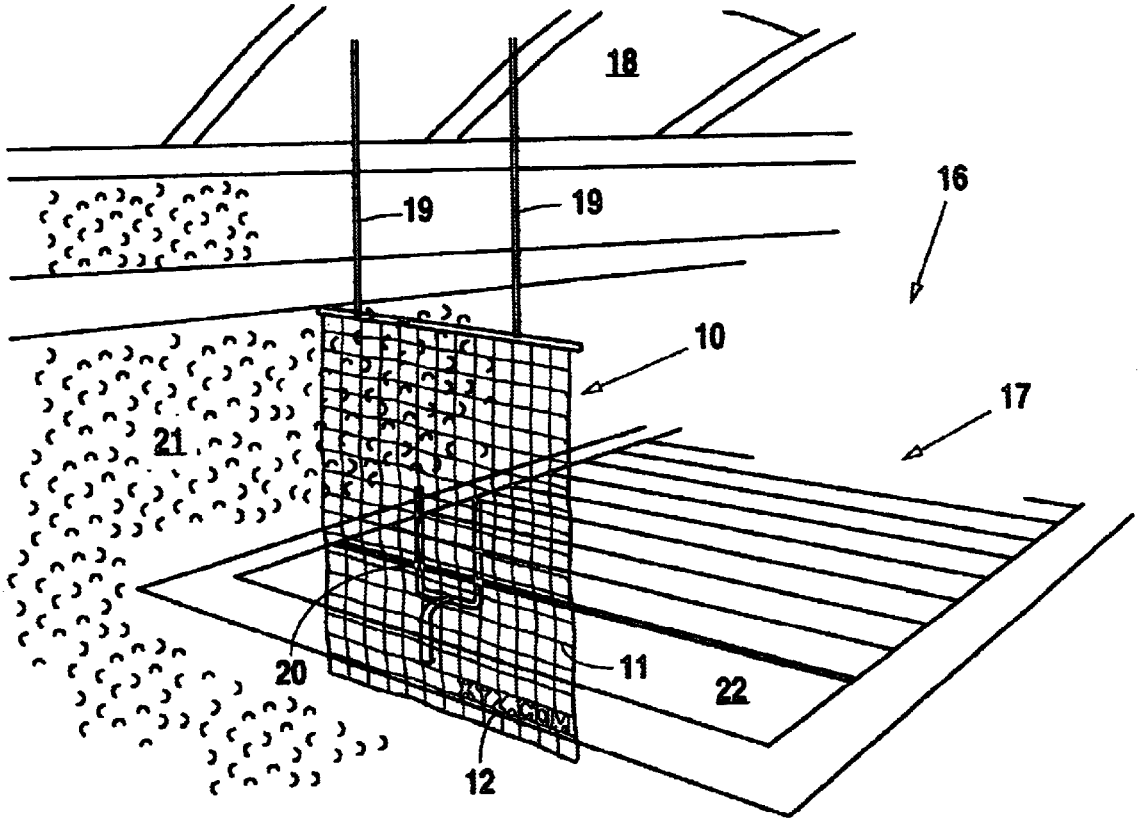
FIG. 2 shows, in a perspective view, a protective net as implemented according to the preferred embodiment of the present invention in order to display advertising content.

Referring now to FIG. 2, the present invention is shown to generally comprise a protective net 10 provided with an appliqué 12 for the conveyance of a commercial message. In order that the spectators 21 at a sporting venue 16 may be presented with a marketing communication without obstruction of their view of the athletic field 22, the appliqué 12 of the present invention generally comprises a mesh 13 of only slightly less dimension than has the mesh 11 of the protective net 10.

Additionally, the narrow mesh 13 may be made of a material having a different (and preferably lighter) shade or color than the preferably black wide mesh 11 of the protective net 10. Because the narrow mesh 13 of the appliqué 12 is affixed to the protective net 10 such that only a small percentage of the surface area of the protective net 10 is covered the view of the field 22 from the spectator's location remains generally unobstructed notwithstanding the relatively smaller dimension of the narrow mesh. Further enhancing the ability to generally see through the appliqué 12, it is noted that the applique 12 comprises a high percentage of open area between its fibers.

Figure 3:
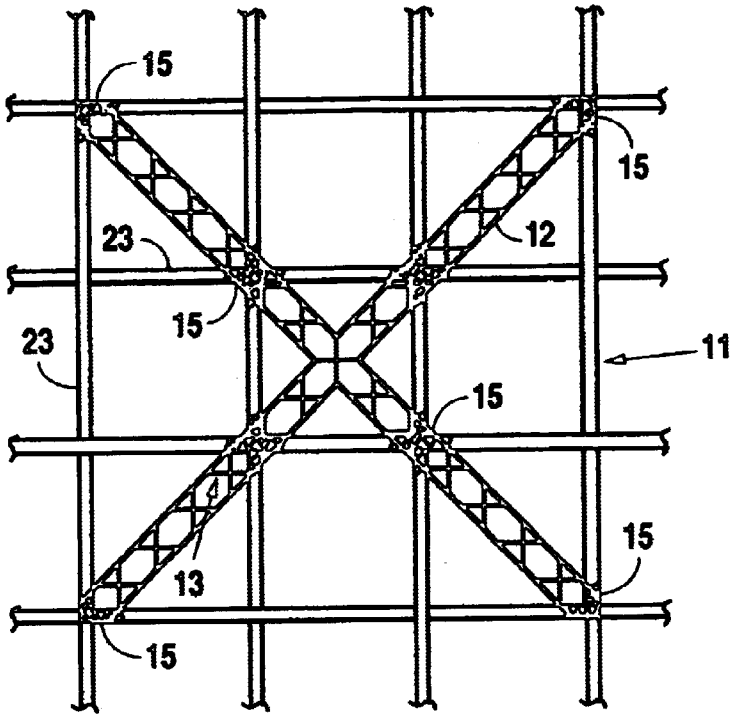
FIG. 3 shows, in an elevational view, detail of a view-preserving appliqué as applied to an otherwise conventional protective net such that advertising content may be conveyed without obstruction of spectators' views.

As shown in FIG. 3, the narrow mesh 13 of the appliqué 12 may be affixed to the wide mesh 11 of the protective net 10 with stitching 15 to the cordage 23 of the wide mesh 11. In this manner, various appliques 12 may be readily placed on the protective net 10 and also readily removed therefrom.

Figure 4:
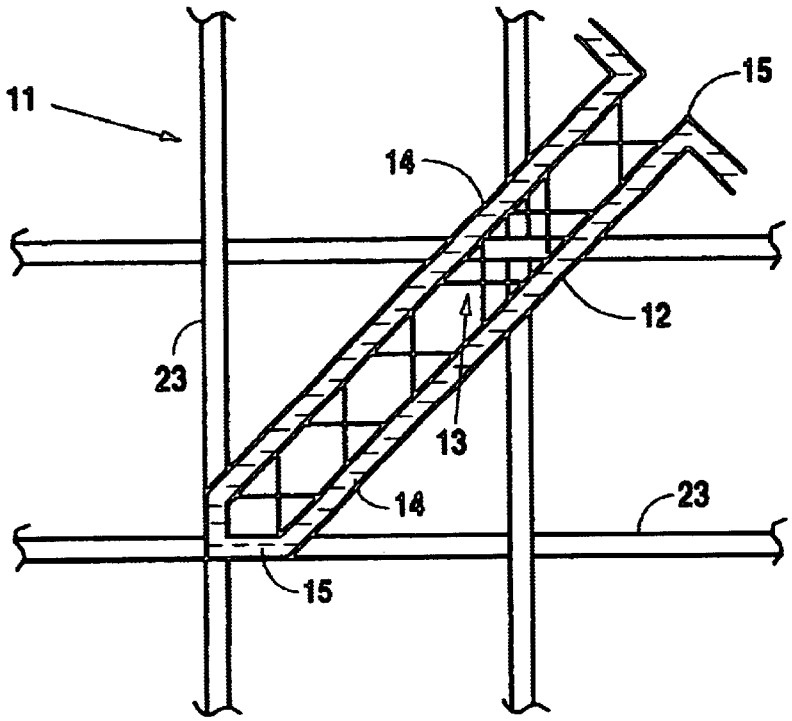
FIG. 4 shows, in an elevational view, an extension of the present invention.

As shown in FIG. 4, in at least one embodiment of the present invention the applique 12 may be provided with a border 14 of a reflective material. In particular, any of variety of high gloss reflective films such as are commercially available (for use in safety products) from 3M under the trademark "SCOTCHLITE" may be utilized to provide such a border 14, thereby enhancing the otherwise subtle impression made by the appliqué 12. As will be appreciated by those of ordinary skill in the art, such a border 14 should be made relatively narrow in order that the applique 12 does not become overly distracting for the spectators 21.

In a further embodiment of the present invention, it is noted that the cordage 23 of the wide mesh 11 and/or the narrow mesh 13 may also be dyed with a reflective material in order to provide a similar effect. To this end, Applicant has found that such materials as the silver graphite reflective materials commercially available from 3M under the trademark "SCOTCHLITE" are suitable for dyeing cordage 23 comprising cotton, polyester and/or other similar fabric materials.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A safety netting arrangement adapted to display advertising content at a sporting venue, said safety netting arrangement comprising:

a first panel comprising a first sized open mesh netting, said first panel being adapted for protection of spectators at a sporting event without significant obstruction of the spectator's view through said first panel;

a second panel comprising a second sized open mesh netting, said second panel being dependently superimposed upon said first panel and said second sized open mesh netting having sufficient open space so as to not significantly obstruct the spectator's view through said second panel; and wherein said second sized open mesh netting comprises open spaces of less area than does said first sized open mesh netting such that the superimposing of said second panel upon said first panel creates an image upon said first panel.

2. The safety netting arrangement as recited in claim 1, wherein said mesh netting of said first panel is black in color.

3. The safety netting arrangement as recited in claim 2, wherein said mesh netting of said second panel is a color other than black.

4. The safety netting arrangement as recited in claim 2, wherein said mesh netting of said second panel is a shade lighter than the shade of said mesh netting of said first panel.

5. The safety netting arrangement as recited in claim 1, wherein said first panel is dependently superimposed upon said first panel by stitching the cordage of said mesh netting of said second panel the cordage of said mesh netting of said first panel.

6. The safety netting arrangement as recited in claim 1, wherein said second panel comprises a border.

7. The safety netting arrangement as recited in claim 6, wherein said border comprises a reflective material.

8. The safety netting arrangement as recited in claim 7, wherein said reflective material comprises a reflective film.

9. The safety netting arrangement as recited in claim 1, wherein said mesh netting of said second panel comprises a fiber dyed with reflective material.

10. The safety netting arrangement as recited in claim 9, wherein said reflective material comprises silver graphite.

11. The safety netting arrangement as recited in claim 10, wherein said fiber comprises cotton.

12. The safety netting arrangement as recited in claim 10, wherein said fiber comprises polyester.

* * * * *